US006267260B1

(12) United States Patent
Lyons

(10) Patent No.: US 6,267,260 B1
(45) Date of Patent: Jul. 31, 2001

(54) TRASH CONTAINER DOOR OPENING APPARATUS

(76) Inventor: Kevin J. Lyons, 4 Admiral Dr. #436, Emeryville, CA (US) 94608

( * ) Notice: Subject to any disclaimer, the term of this patent is extended or adjusted under 35 U.S.C. 154(b) by 0 days.

(21) Appl. No.: 09/198,046

(22) Filed: Nov. 23, 1998

(51) Int. Cl.[7] ..... B65D 25/28

(52) U.S. Cl. ..... 220/212.5; 220/263; 220/264; 220/908; 16/110.1; 16/425

(58) Field of Search ..... 220/263, 264, 220/212.5, 908, 481, 482, DIG. 25; 16/110.1, 425, 426, 429

(56) References Cited

U.S. PATENT DOCUMENTS

| | | | | |
|---|---|---|---|---|
| 1,365,686 | * | 1/1921 | Harvey | 220/263 X |
| 2,450,193 | * | 9/1948 | Galliano | 16/425 X |
| 2,531,503 | * | 11/1950 | Dick | 220/264 X |
| 3,389,826 | * | 6/1968 | Wall | 220/264 |
| 4,135,725 | * | 1/1979 | DiRoma | 16/425 X |
| 4,880,133 | * | 11/1989 | Cullinane | 220/482 X |
| 4,907,715 | * | 3/1990 | Bloomer | 220/263 |
| 5,147,056 | * | 9/1992 | Ma | 220/263 |
| 5,372,271 | * | 12/1994 | Miller et al. | 220/263 |
| 5,398,374 | * | 3/1995 | Betancourt | 220/212.5 |
| 5,531,348 | * | 7/1996 | Baker et al. | 220/264 |
| 5,538,338 | * | 7/1996 | Biggers | 220/264 X |
| 5,671,859 | * | 9/1997 | Sheu et al. | 220/263 |
| 5,778,489 | * | 7/1998 | Marshall, II | 16/425 X |

* cited by examiner

*Primary Examiner*—Stephen K. Cronin

(57) ABSTRACT

An apparatus for opening a trash container door flap, is designed to be rapidly and easily retrofittable onto trash containers having pivoting doors, particularly of the type found in limited-service or fast-food restaurants. The apparatus includes a novel means of attachment to the door flap from which a hand lever and/or a line to a foot pedal may be attached. The attachment means to the door may consist of a clamp that fits over an edge of the door in the space between the door and the cabinet, without interfering with the rotation of the door. A vertical lever may be attached to the clamp or an extension from it so that the door may be easily pivoted with one hand without contacting it. A line such as a cable may also be attached to the clamp or extension, and then down to a freestanding foot pedal that may be used to open the door without the use of ones hands. In a configuration with both the lever and the foot pedal attached, the door may be opened with one hand using the lever, no hands using the pedal, or as before by pushing inward on the door with ones hands or a tray. The apparatus may also be installed or removed in seconds due to the nature of the novel attachment to the door flap.

14 Claims, 7 Drawing Sheets

TRASH CONTAINER DOOR OPENING APPARATUS

BACKGROUND OF THE INVENTION

1. Field of the Invention

The present invention relates to a trash container door opening apparatus. More particularly the invention relates to an apparatus for opening any unmodified trash container door flap (e.g., a flap that does not already comprise such an apparatus), and that features an attachment means that allows the apparatus to quickly and easily be installed or removed from trash containers having door flaps, including the sort found in limited-service restaurants and elsewhere.

2. Description of the Related Art

Trash containers are frequently comprised of a base portion to hold the trash and a top portion having a pivoting door flap that usually remains closed due to gravity or spring forces. Trash containers of the type commonly found in limited-service restaurants are typically comprised of an external cabinet having a top on which empty trays are stored, and a swinging door near the top of one of the sides. This door hangs closed but can be pushed open with one's hand or with a tray so that garbage may be deposited into the trash bin on the inside.

When a tray having trash on it is used to push the flap open, the flap inevitably forces the trash (which may include liquids and other food remains) off of the tray, and in many cases onto the front of the flap, the cabinet, the floor or the person emptying their tray. Alternatively the door may be pushed open with the trash in ones hand, which is generally awkward, or with ones hand itself which may be unpleasant and unsanitary. In all cases the flap may be difficult to push fully open and it may be soiled from previous garbage disposal.

In an attempt to overcome the problems associated with conventionally known trash containers, as described above, there have been various assemblies developed which are designed to move a door flap open without having to push the flap panel open by contacting it with ones hand, trash or tray. U.S. Pat. No. 5,398,374 "Handle Assembly for Trash Bin" describes a handle mounted to the front of a trash container lid that extends forward in a manner that unbalances the door and interferes with disposal. U.S. Pat. No. 5,172,823 "Combination Dustpan and Trapdoor Receptacle Closure" describes a removable door that is shaped to also be used as a dustpan. U.S. Pat. No. 5,372,271 "Pedal Actuated Waste Disposal Bin" describes a container with a foot pedal system consisting of a fixed linkage combined with a flexible linkage running across the bottom of the container, then up the back and across the top over pulleys to the back of the door to open it. U.S. Pat. No. 5,163,574 "Pedal Trash Bin" describes a system in which the door is closed by springs when the foot pedal is released. U.S. Pat. No. 5,147,056 "Foot Actuated Opener for Trash Bin" describes a foot pedal mounted in a slot toward the bottom of the container from which a cable runs upward and backward inside the container, then over a pulley attached to the inside wall of the container and down to the back of the door flap. U.S. Pat. No. 4,907,715 "Door Opener" describes a hand operated push-pull cable system to open and close the door flap. U.S. Pat. No. 4,765,548 "Garbage Disposal Apparatus" describes a cabinet with a vertically slideable panel that is actuated with a foot pedal, instead of a door flap.

Because these inventions are too complex, require a new container or too much in the way of time, tools and effort to install, and because they often interfere with the existing mode of operation or with the interior container management, these systems have not been successful in the marketplace. The door flap opening problem still remains however, and has caused some restaurants to adopt open top containers for their ease of use in disposal, in spite of their drawbacks in terms of being unsightly and generating more odor than the types with closing door flaps as described above. There still exists a need in the present art for a foot or hand operated apparatus for opening these types of trash containers, especially for the large installed base of existing containers. Among other features, the improved apparatus would not require a new cabinet or container for its implementation, would not require modification to an existing cabinet or container, would not interfere with the disposal of trash or with the removal or replacing of the trash can located inside, and would not interfere with the traditional method of door operation for those who might prefer it.

The improved apparatus would also be designed to be installed or removed quickly and easily, without requiring tools, and could be installed as a retrofit onto an existing trash container, or, on new containers. As such, the apparatus would want to avoid incorporating, among other things: a large number of parts or attachments to the container, such as pulleys and fasteners, as might be required by an extensive linkage system. The improved apparatus would also be easily adjusted or otherwise adapted for installation on various types, sizes and shapes of trash containers having doors. Besides wood cabinets of the kind found in fast food restaurants, the usefulness of the ideal apparatus design should be easily applied to other containers having door flaps, such as metallic or plastic containers with domed or rectangular tops having gravity closing or spring loaded doors.

SUMMARY OF THE INVENTION

The present invention is a novel, easily retrofittable design that meets the above specifications for opening such trash containers. The attachment strategy takes advantage of the built-in rotational leverage on the door flap and accordingly, the apparatus is comprised of a minimum of components, which are easily installed on trash containers without tools. Unlike any of the previous inventions, which require components like pulleys, springs, linkages and push-pull cables and their associated attachments, the invention herein does not require such hardware. Other than a single attachment to the door, it requires no attachments to other parts of the trash container. It can be setup and installed onto an existing trash container, or removed from one, in seconds, without any tools or modification to the door or other parts of the container. Due to these and other characteristics, this invention provides all of the benefits sought by previous inventions while avoiding the drawbacks. The invention greatly simplifies emptying trash from a food tray by preventing interference of the lid with the garbage on the tray when disposing of trash. When disposing trash with ones hands, it eliminates the need for touching unpleasant and unsanitary spilled food and packaging wastes on the lid itself. The invention does not interfere with the traditional opening technique of manually pushing the flap inward, and once installed, the invention does not restrict access to the inside of the container for changing of trash bins. If desired, the invention can also be quickly and easily removed for cleaning or repair and takes up a minimum of space when not in use.

One aspect of this invention is to provide a system for either one-hand, one-hand-or-hands-free, or hands-free opening of a trash container door without making hand or tray contact with the door. Another aspect of the invention is to provide such an apparatus that is comprised of components that can be easily installed, so that it can be quickly retrofit on the many versions trash containers with door flaps already installed, as well as easily included as new ones are constructed. Another aspect of this invention is to provide a system that uses the built-in pivoting axis of the lid as the basis of and leverage point for the foot or hand actuated opening rotation.

The one-hand embodiment of this invention comprises 1) a clamp, clip, adjustable bracket, or other attachment means that is placed over an edge of the door flap, typically on or near the top edge, and 2) a lever attached to 1), and that typically extends vertically upward and backward over the top of the cabinet for neutral balance and minimal interference with disposal. The way in which the lever extends is dependent on the balance of the door flap and the trash container design. The lever typically has a handle such as a knob for easy grasping and pulling. The lever may be hand actuated or otherwise, but this first embodiment is directed toward manual operation of the lever. The hands-free embodiment of this invention comprises 1) a clamp, clip, adjustable bracket, or other means for attachment which is placed over an edge of the door flap; 3) a foot actuated pedal located on the floor, or otherwise securely situated near the bottom of the trash container; 4) a durable cable, strap or other line that leads from the pedal directly to 1) or to 5) an extension from 1). The pedal line may lead upward, over the top of the hinged swinging door flap, through the small gap below the top panel, and then down over the back of the lid, to the attachment. Alternatively, the extension to the attachment to the door may extend outward and sideward from the front of the lid, typically from the top left or right corner, and could make the attachment to the line there, instead of running up, over and down the back of the door. This embodiment of the invention is operated by displacing the pedal downward, typically with ones foot, which pulls the line downward and causes the door flap to rotate inward to an extent dependent on the extent of displacement of the foot pedal.

The one-hand-and-hands-free embodiment of this invention implements a combination of the one-hand and hands-free embodiments such that the apparatus may be operated by displacement of the foot pedal or displacement of the hand lever, which may be individually attached to the door. Alternatively, a single attachment to the door may be used to attach both the hand lever and the line to the foot pedal.

One or more of the attachments, hand levers or foot pedals may be used on a single trash container and many configurations are possible. A typical installation on a fast-food type trash container might consist of one hand lever on each upper corner of the door, and one flexible line running downward on one side to a wide foot pedal, with the line side chosen to not interfere with the large bottom door providing access to emptying the interior container. With such an installation, the user can open the trash lid using the foot actuated pedal, the hand lever, or traditionally by pushing the flap itself with their tray or hand. A single hand lever might also be typical on this or other containers. The positioning of the attachments over a particular edge, and the design of the attachment are intended to vary with the specific container design, especially varying with the location of the pivot axis of the door flap. The particular positioning and design are chosen primarily to minimize interference with the door flap closing, provide ease of installation and maintain door flap balance.

This invention may be used in part or in whole with any trash containers with at least one door flap, such as those found on the top assembly of the many metallic, wooden or plastic containers with domed or rectangular tops having gravity closing or spring loaded doors. Other specific examples where the invention is likely to find use include metal dome top trash cans having a domed or flat lid as typically found in coffee and beverage shops and flat spring loaded lids as typically found in commercial airplane bathrooms.

BRIEF DESCRIPTION OF THE DRAWINGS

For a fuller understanding of the nature of the present invention, reference should be made to the following detailed description taken in connection with the accompanying drawings in which.

DETAILED DESCRIPTION OF THE PREFERRED EMBODIMENTS

Figure 1:
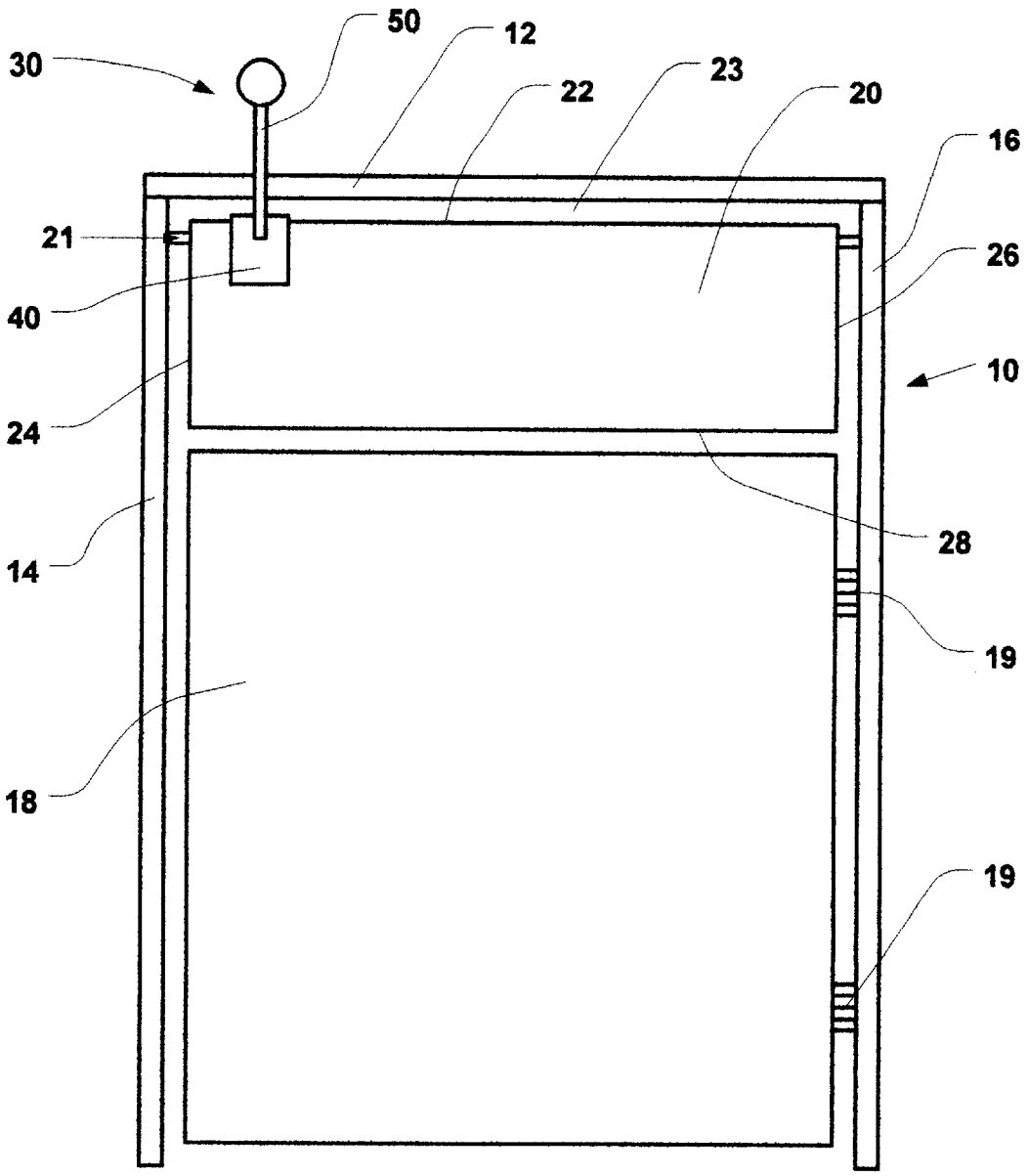
FIG. 1 is a front view showing the apparatus in a one-hand configuration.

Referring to FIGS. 1–8, there are generally illustrated several configurations of the door flap opening apparatus of the present invention. FIG. 1 depicts, from the front, a preferred embodiment of a one-hand apparatus 30 designed for opening the door of a trash container 10, of the type found in fast-food restaurants. The container has a top panel 12, left side panel 14, right side panel 16, lower door panel 18, lower door panel hinges 19, and a door flap 20. The door flap 20 has a pivot axis 21, top edge 22, below a top edge gap 23, left side edge 24, right side edge 26, and bottom edge 28. The apparatus 30 depicted comprises a clamp 40 and a lever 50. The clamp can be any sort of clamp known to those skilled in the art for attaching to the door flap, including clips, u-channels, brackets, etc., such as those that do not prevent the operation of the door flap 20, fit door flaps of varying sizes, and preferably do not interfere with the operation of the door flap.

Figure 2:
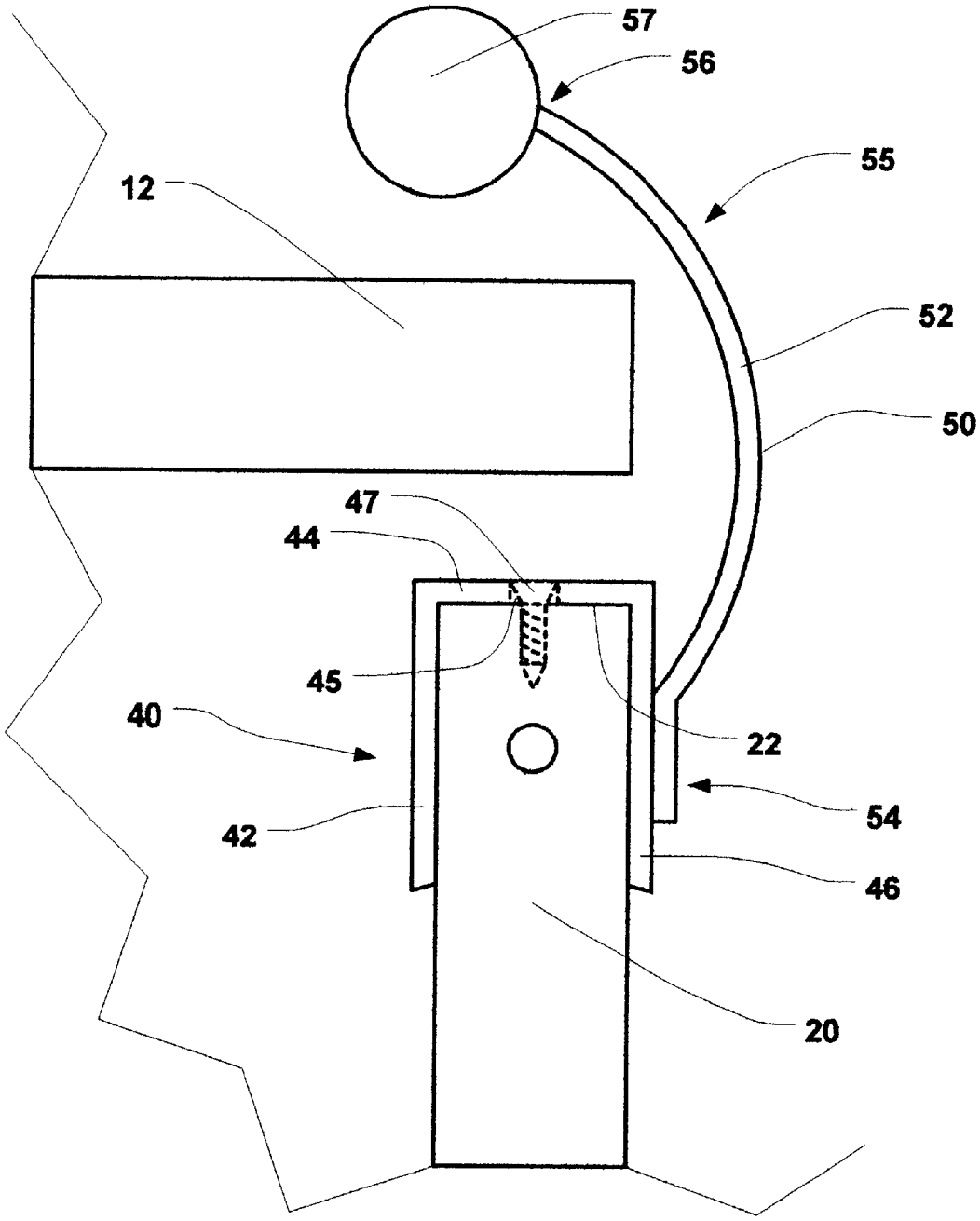
FIG. 2 is a detailed side view and partial cutaway showing the apparatus in a one-hand configuration.

FIG. 2 is a more detailed side view that shows the clamp 40, with its rear face 42, top face 44, an optional hole in the top face 45, a front face 46 and an optional screw 47. The clamp sits over the top edge 22 of the door flap 20 and the top face of the clamp 45 is thin enough so as to fit in the top edge gap 23 and not interfere with the top panel 12 when pivoting. Although shown on the top edge of the door flap, it could also be placed on the side edge or bottom edge. Adjustment for the balance of the apparatus with the door flap is needed with these embodiments, and such adjustment, primarily by choice of lever and attachment, is within the skill in the art. A lever 50 extends upward from the clamp and comprises a rod 52 that is attached at the bottom end 54 to the clamp's front face 46, a middle section 55 that bends over the top 12 of the trash container for neutral balance, and a top end 56 to which a knob 57 may be attached for easy grasping. The rod may be any sort of bar, strip, wire, etc., of any material, such as those that have sufficient strength to displace the door flap when manipulated. The knob may be replaced with another attractive piece, such as a logo or trademark for a restaurant. The knob 57 is optional. This bending shown is for balance adjustment and can be modified depending on the door flap. For example, if the door flap is made of wood or a wood product, then the balance will be different if the door is made of another materials having a different weight. Some door flaps are already weighted or spring loaded to allow for ease of operation and the balance and shape of the lever is adjusted to account for such door flaps. This bending may also be modified to avoid interference with the container.

Figure 3:
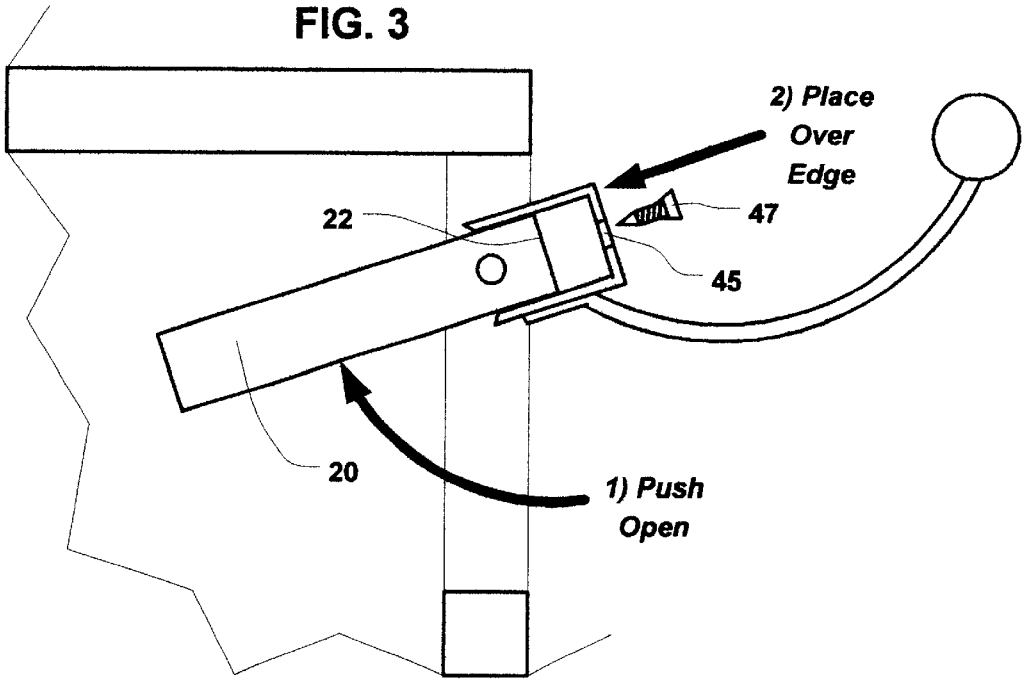
FIG. 3 is a side view and partial cutaway illustrating installation of the apparatus in a one-hand configuration.

As illustrated in the cutaway side view of FIG. 3, to install the apparatus on a door flap, the door flap 20 is pushed in and held open with one hand, and the clamp is placed over the top edge 22. The door is then allowed to swing close and the invention is ready to use. Though not necessary, a screw 47 could be installed through an optional hole 45.

Figure 4:
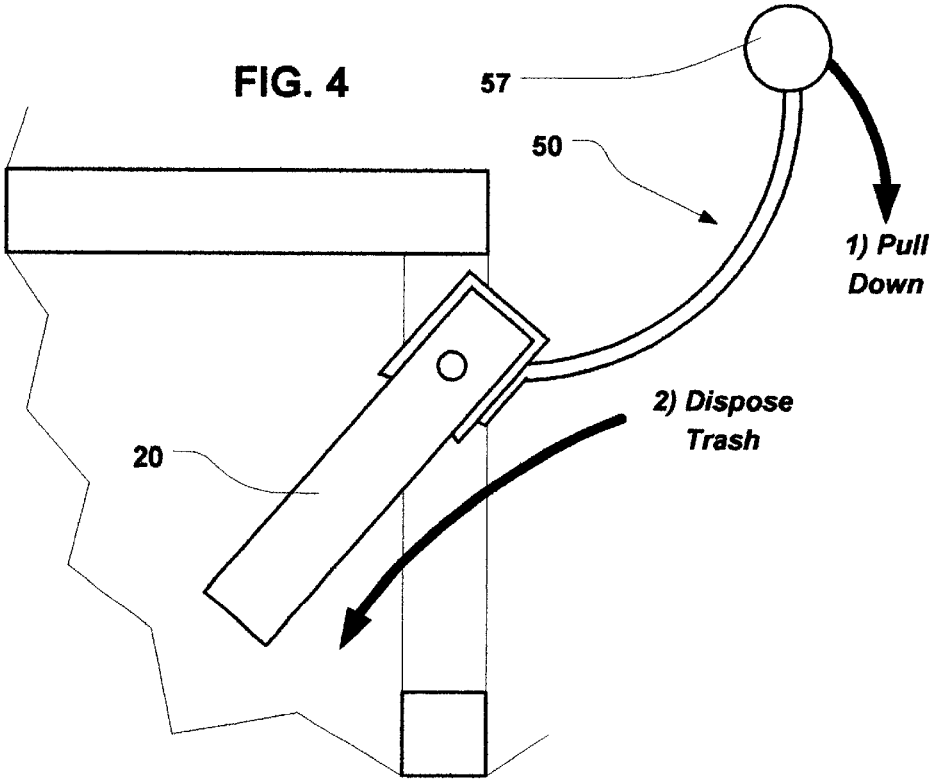
FIG. 4 is a side view and partial cutaway illustrating operation of the door flap and disposal of trash using a one-hand configuration.

As illustrated in FIG. 4, to operate the installed apparatus one grasps the knob 57 and pulls the lever 50 toward the front, causing the door flap 20 to rotate inward, where it can be held while trash is disposed. To close the door flap 20, the lever 50 is released and the door flap and lever can return to their starting position.

Figure 5:
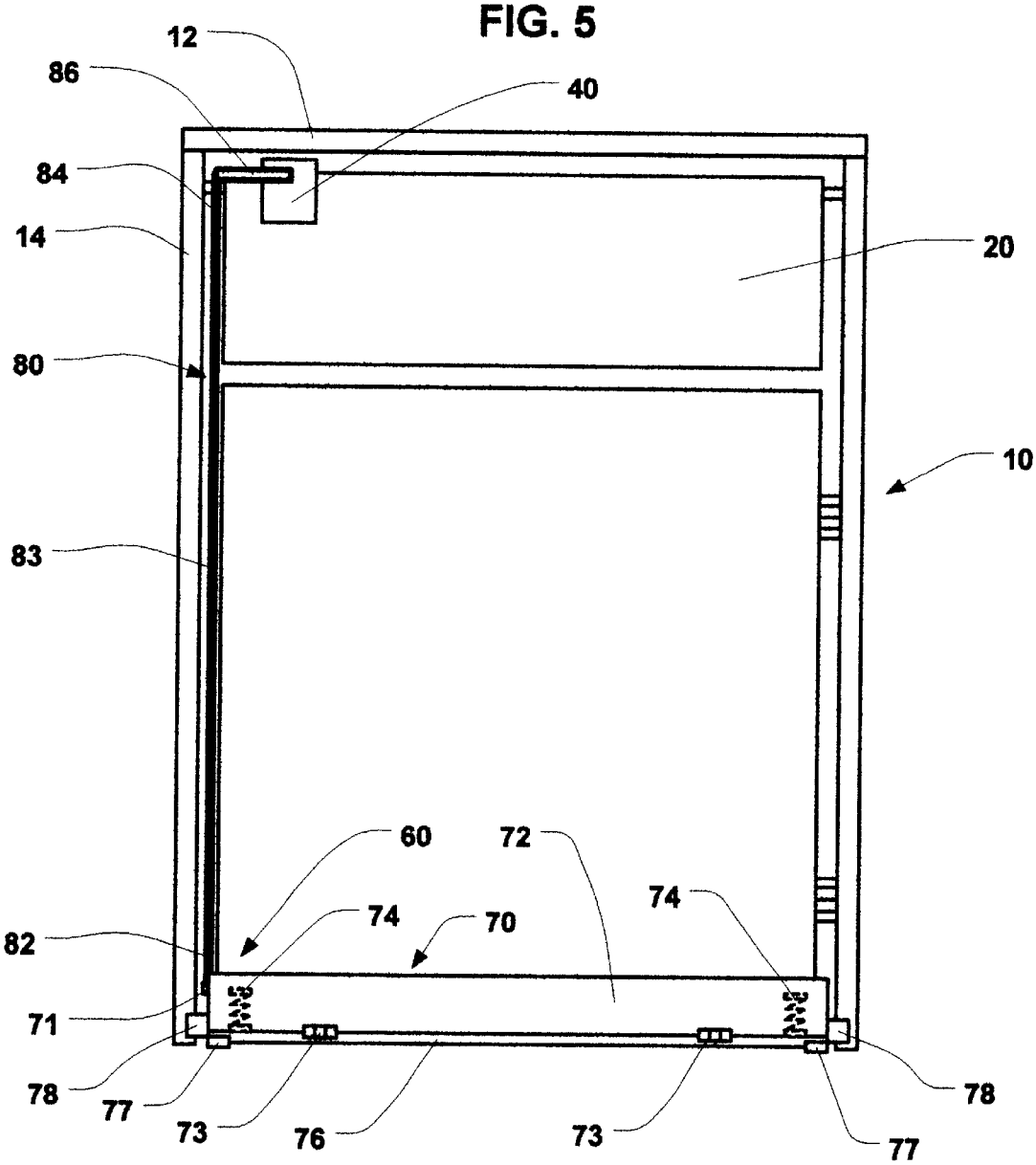
FIG. 5 is a front view showing the apparatus in a hands-free configuration.
Figure 6:
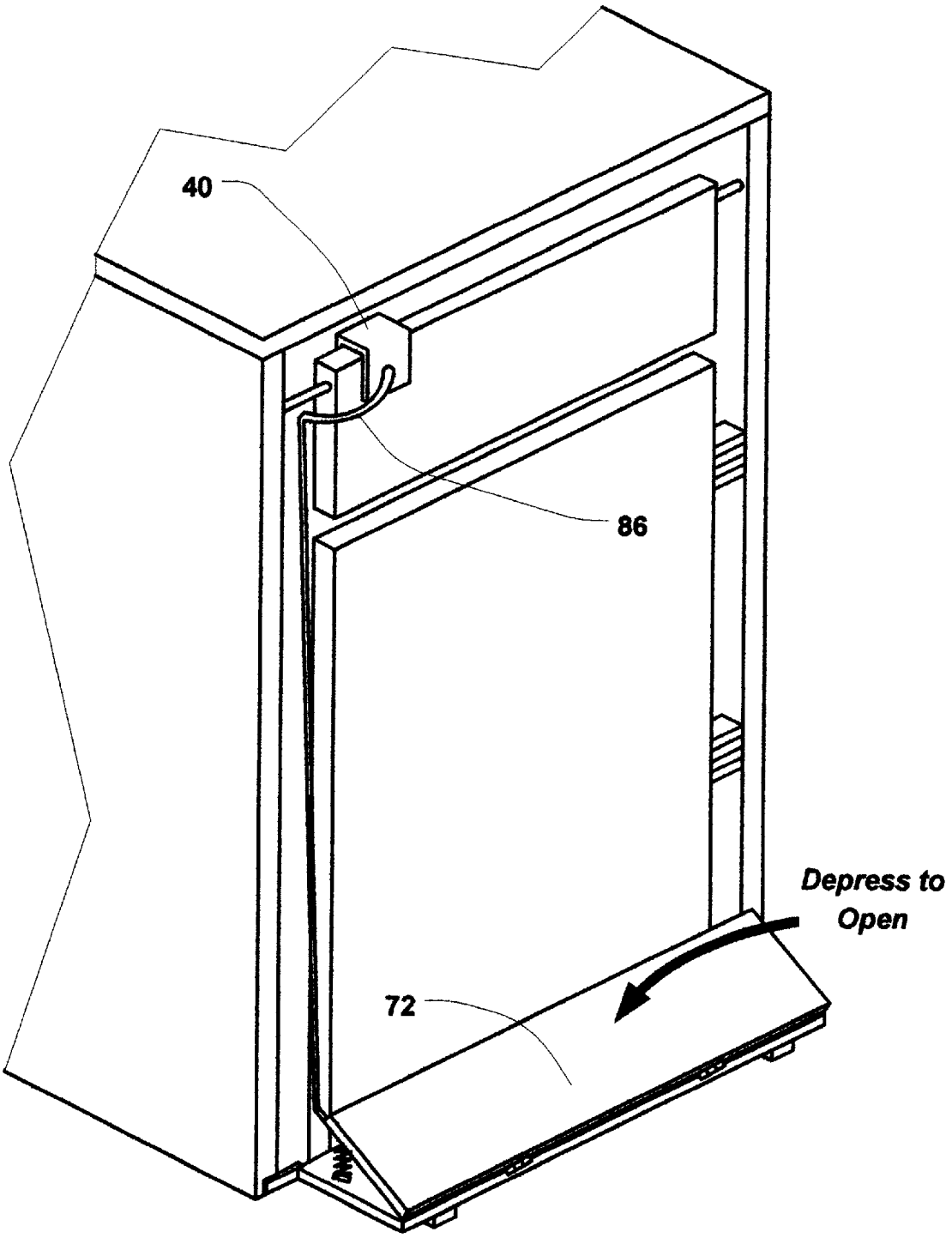
FIG. 6 is a perspective and partial cutaway view showing the invention in a hands-free configuration.

FIG. 5 is a front view of the apparatus in a hands-free configuration. The container 10 and door flap 20 are the same as in FIGS. 1–4. The clamp 40 is also shown as the same, although the other embodiments discussed above could also be employed. In the hands-free configuration there is, in place of the lever, a foot operated system 60 comprising a foot pedal 70 and a line 80 from the clamp 40 to the foot pedal 70. The line comprises a bottom end 82 attached to the foot pedal 70, a middle section 83, and a top end 84 which may be attached to the clamp 40 directly or, as shown, to an extension 86 from the clamp. The line may be any flexible or rigid cable, wire, rope, rod, etc., of any material, such as those that have sufficient strength to displace the door flap when manipulated. The extension 86 typically extends slightly forward out from the door flap 20 and sideward beyond the side panel 14 so as not to interfere with either the top panel 12 or the side panel 14 when the door flap is pivoting. The foot pedal 70 has a top 72, with a connection point 71 to the line 80. The foot pedal also has hinges 73, springs 74, a bottom 76, with nonskid feet 77 and optional removable mounts 78 to the trash container. FIG. 6 is a perspective and cutaway view showing the apparatus in a hands-free configuration. To operate the apparatus and open the door flap, the top 72 of the foot lever is depressed, which causes the line 80 to pull the extension 86 and clamp 40 downward so that the door pivots inwardly. Trash may then be disposed of with one or both hands.

Figure 7:
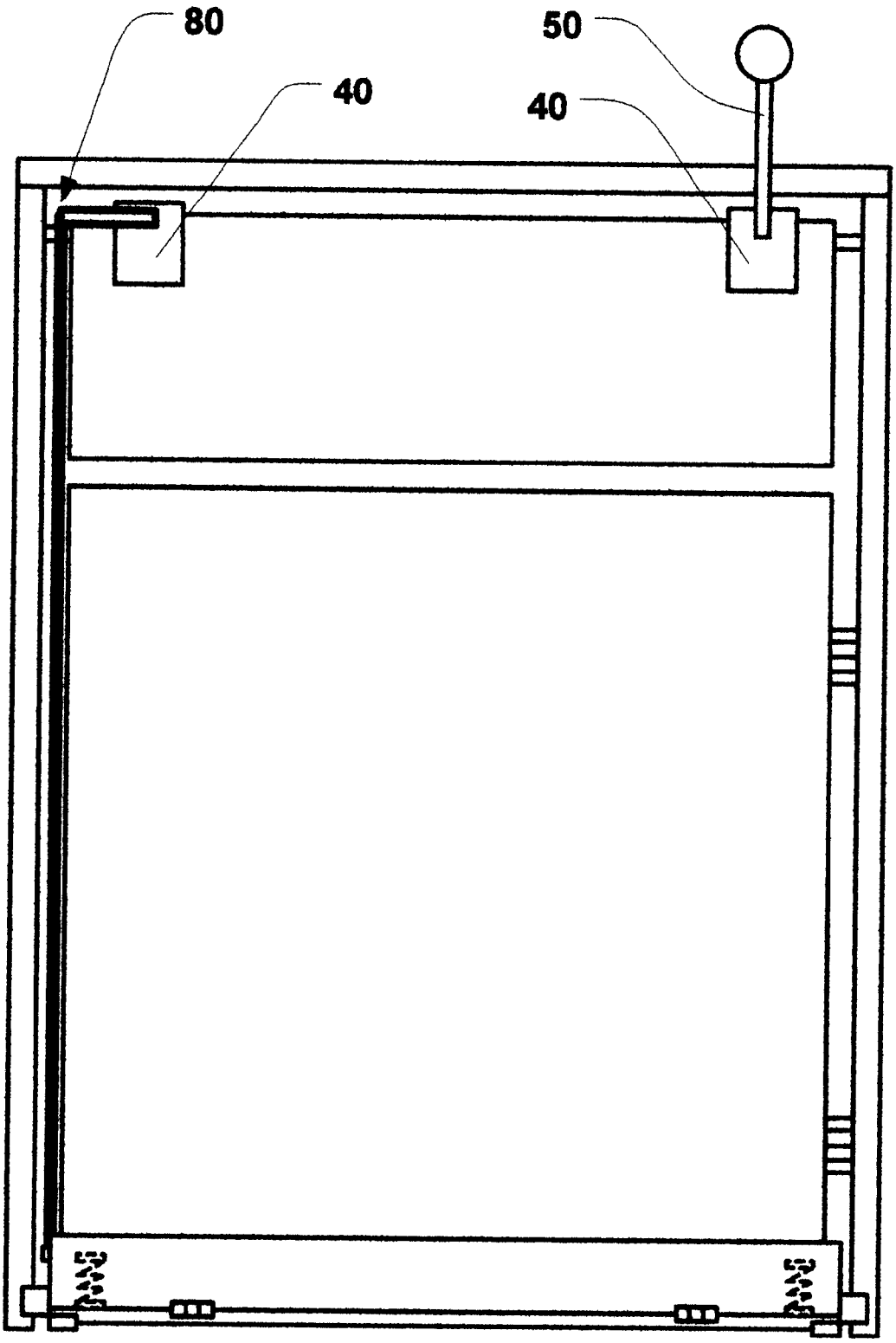
FIG. 7 is a front view showing the apparatus in a one-hand-and-hands-free configuration.

In an alternative aspect, FIG. 7 shows a front view of the apparatus in a one-hand-or-hands-free configuration. The line 80 and lever 50 could alternatively be attached to the same clamp, but multiple clamps 40 are shown.

Figure 8:
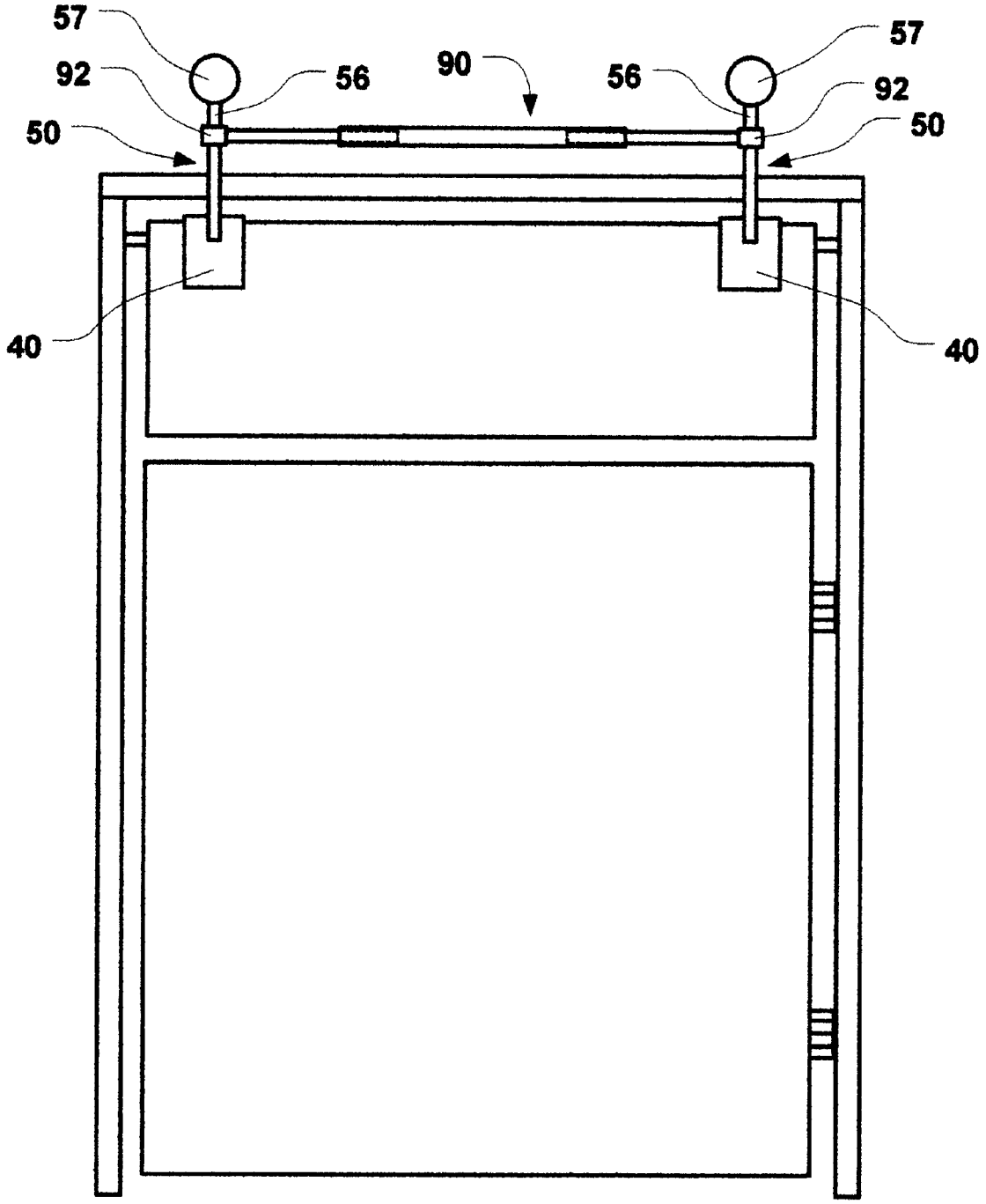
FIG. 8 is a front view and partial cutaway showing the two one-hand configurations with a removable crossbar attached between them.

FIG. 8 is a front view showing a configuration with two clamps 40, two levers 50 and an adjustable length crossbar 90 attached between them. The crossbar 90 is shown with fasteners 92 on its ends for attachment to the tops of the levers 56, though attachment could also have been shown to the knobs 57. The crossbar can be made of any material and may be adjustable or of fixed length. The crossbar 90 may be removable or fixed. The entire system shown in FIG. 8 may be a single piece or multiple pieces and may be removable.

It is to be understood that the above description is intended to be illustrative and not restrictive. Many embodiments will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated herein by reference for all purposes.

What is claimed is:

1. An apparatus for opening a pivotably mounted door flap of a trash container, comprising:

an attachment to the pivotably mounted door flap, with said attachment fitting over an edge of said door flap; and a means for displacing said attachment such that displacing said means causes displacement of said attachment so that said door flap moves to allow access to the interior of said trash container, wherein said means further comprises a lever that extends outward from the door flap and over the top of said door flap as it hangs, such that the door flap remains balanced the same as before the apparatus was installed.

2. The apparatus of claim 1 wherein said lever has a knob on the end.

3. the apparatus of claim 1 wherein there are two attachments and means for displacement on the same door flap with each means comprising a lever attached to said attachment, wherein a horizontal like is mounted between the two levers.

4. A method for mounting the apparatus of claim 1 to a pivotably mounted door flap comprising:

pushing the door flap inward and holding it away from its resting position sliding the attachment over an edge of the door flap returning the door flap to its resting position.

5. An attachment for mounting over an edge of a pivotably mounted door flap of a trash container, comprising:

a back side a front side that is substantially parallel to the back side a top that attaches the front side to the back side wherein a means for displacing said attachment is attached such that said means causes displacement of said attachment so that said door flap swings inward to allow access to the interior of said trash container, wherein the means for displacing the attachment further comprises a line attached to said attachment a t one end and to a foot pedal at the other.

6. The apparatus of claim 5 further comprising an extension displaced between said attachment and said line, with said extension allowing for said attachment to be installed a given distance from the edge of said door flap.

7. The apparatus of claim 5 wherein said foot pedal is freestanding.

8. The apparatus of claim 5 wherein said foot pedal is substantially the same width as the trash container.

9. The apparatus of claim 5 wherein a lever is also attached to said attachment.

10. A method for mounting the apparatus of claim 5 to a pivotably mounted door flap comprising:

pushing the door flap inward and holding it away from its resting position sliding the attachment over an edge of the door flap returning the door flap to its resting position.

11. An apparatus for opening a pivotably mounted door flap of a trash container, comprising:

a container having a pivotably mounted door flap;

an attachment to the door flap that fits over an edge of said door flap a means for displacing said attachment such that said means causes displacement of said attachment so that said door flap moves to allow access to the interior of said trash container, wherein the means for displacing the attachment comprises a line attached to said attachment at one end and to a foot pedal at the other.

12. A method for mounting a detachable attachment to a pivotably mounted door flap comprising:

pushing said door flap inward and holding it away from its resting position sliding the attachment over an edge of the door flap returning the door flap to its resting position.

13. An attachment for mounting over an edge of a pivotably mounted door flap of a trash container mounted with a top gap for pivoting movement, comprising:

a back side a front side that is substantially parallel to the back side a top that attaches the front side to the back side wherein said top is of a thickness not to exceed the width which would cause it contact the container when the door flap is rotated.

14. A method for mounting the attachment of claim 13 to a pivotably mounted door flap comprising:

pushing the door flap inward and holding it away from its resting position sliding the attachment over an edge of the door flap returning the door flap to its resting position.

* * * * *